US005647177A

United States Patent [19]

Hwang

[11] Patent Number: 5,647,177

[45] Date of Patent: Jul. 15, 1997

[54] MODULAR HOUSE

[75] Inventor: Jong-Liang Hwang, Kaohsiung, Taiwan

[73] Assignee: Tu Ling Aluminum Engineering Co., Ltd., Kaohsiung, Taiwan

[21] Appl. No.: 578,279

[22] Filed: Dec. 26, 1995

[51] Int. Cl.[6] ..... E04B 1/343

[52] U.S. Cl. ..... 52/79.5; 52/265; 52/270; 52/282.3; 52/284

[58] Field of Search ..... 52/79.1, 79.5, 52/264, 265, 270, 282.1, 282.2, 282.3, 284

[56] References Cited

U.S. PATENT DOCUMENTS

| | | | |
|---|---|---|---|
| 4,161,089 | 7/1979 | Omansky | 52/274 X |
| 4,381,632 | 5/1983 | Geitner | 52/282.1 X |
| 4,493,172 | 1/1985 | Jones | 52/282.3 X |
| 4,677,797 | 7/1987 | Roth | 52/94 |
| 4,914,879 | 4/1990 | Goldberg | 52/282.1 X |
| 4,967,520 | 11/1990 | Post, Jr. et al. | 52/79.5 |
| 5,293,725 | 3/1994 | Matticks et al. | 52/271 X |

*Primary Examiner*—Christopher T. Kent
*Attorney, Agent, or Firm*—Finnegan, Henderson, Farabow, Garrett & Dunner

[57] ABSTRACT

A modular house includes a floor assembly, a peripheral wall assembly and a roof assembly. The floor assembly includes an annular frame unit adapted to be received fittingly within a rectangular cavity of the ground, and a floor unit fitted within the frame unit. The frame unit includes two U-shaped frames which abut against each other side by side and which has an annular floor slot unit formed in the inner peripheral surface thereof, and an annular groove formed in the top surface thereof. The floor unit includes two rectangular floor halves having outer peripheries which are engaged within the floor slot unit of the frame unit. Four vertical corner pillars stand on the corners of the floor assembly and have lower ends retained in the annular groove of the frame unit so as to define four wall spaces, in each of which at least one rail, a heating insulating plate unit and a sound absorbing plate unit are provided.

9 Claims, 11 Drawing Sheets

MODULAR HOUSE

BACKGROUND OF THE INVENTION

This invention relates to a modular house, and more particularly to a modular house which can be easily mounted on and dismounted from the ground.

In this art, it is difficult for a small-size wooden house to mount on and dismount from the ground.

SUMMARY OF THE INVENTION

It is therefore the main object of this invention to provide a modular house which can be easily mounted on and dismounted from the ground.

According to this invention, a modular house has a floor assembly including an annular frame unit adapted to be received fittingly within a rectangular cavity in the ground, and a floor unit fitted within the annular frame unit. The annular frame unit includes two generally U-shaped frames defining a floor space therebetween, a top surface formed with an annular groove, and an inner peripheral surface formed with an annular floor slot unit. Each of the frames has two parallel and straight side bar portions and a connecting bar portion interconnecting the side bar portions. Each of the side bar portions and the connecting bar portions of the frames is of a generally U-shaped cross-section and has two parallel vertical side walls defining the annular groove therebetween, a horizontal bottom wall interconnecting the lower ends of the side walls, and an open-ended horizontal floor slot formed in one of the vertical side walls along the total length of the bar portion so that the floor slots together constitute the floor slot unit. Each of the floor unit includes two floor halves which have outer peripheries respectively and slidably engaged within the floor slots of the frames and which abut against each other side by side. A peripheral wall assembly includes four rectangularly arranged corner pillars defining four wall spaces each of which is located between an adjacent pair of the corner pillars, and four pillar retainer units respectively and removably mounting the lower end portions of the corner pillars in the annular groove of the annular frame unit. Four rails are disposed in the wall spaces respectively. Four rail retainer units respectively and removably mount the rails on the pillars. Four outer corner posts are respectively and removably connected to the corner pillars so as to cooperate with four spaced sets of removably interconnected outer wall sections, thus constituting an annular outer wall unit which surrounds the corner pillars and the rails. Four spaced sets of removably interconnected inner wall sections are disposed on the floor assembly. Four inner corner posts are respectively and removably connected to the corner pillars so as to cooperate with the inner wall sections, thus constituting an annular inner wall unit, in such a manner that the corner pillars and the rails are located between the inner and outer wall units. The outer wall unit has two opposite side walls each of which has a tapered top end portion, so that an inverted V-shaped roof assembly is mounted removably on the wall assembly.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
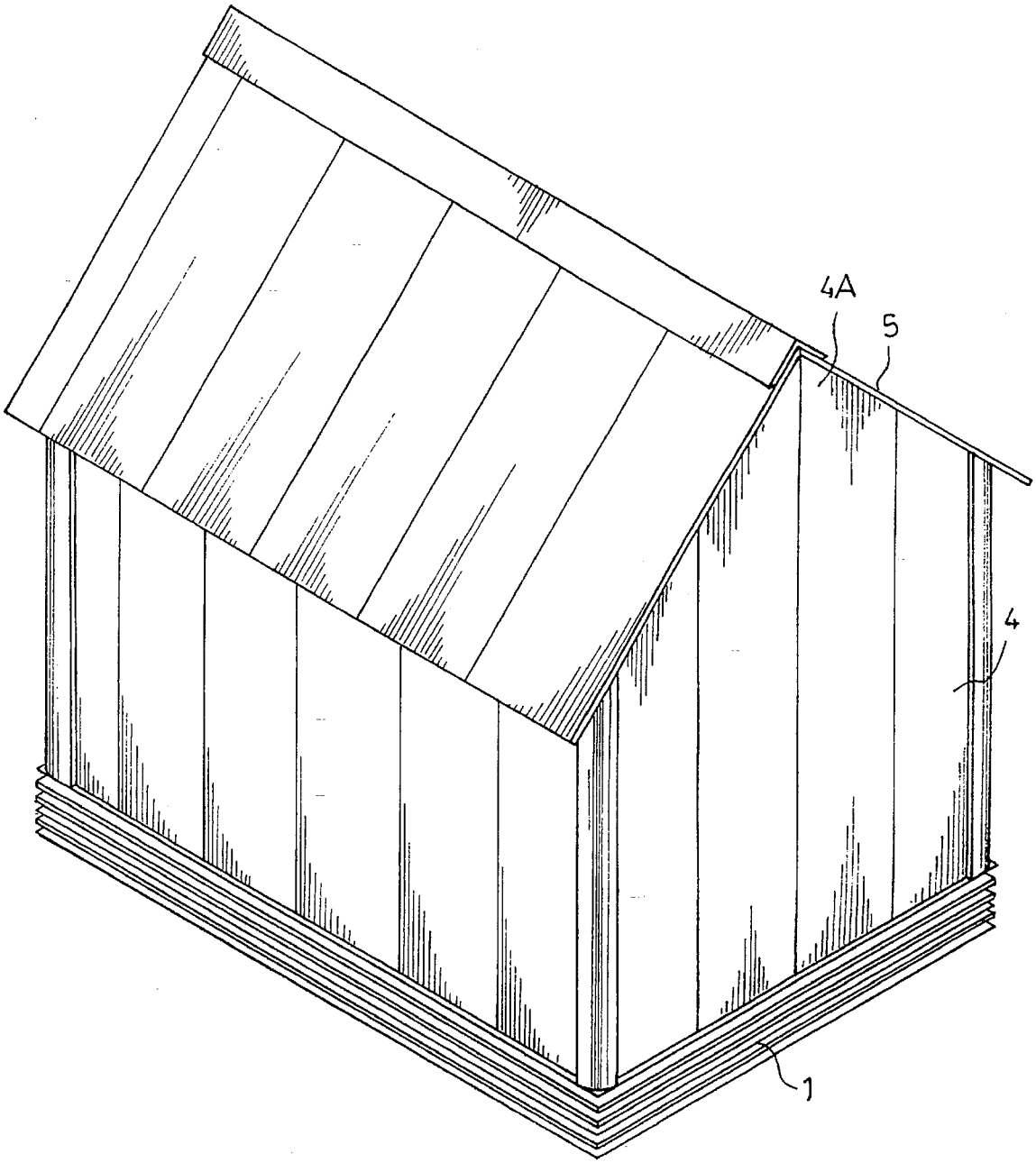
FIG. 1 is a perspective view of a modular house according to this invention.

Referring to FIG. 1, a modular house of this invention consists of a floor assembly 1, a peripheral wall assembly 4 and an inverted V-shaped roof assembly 5.

Figure 2:
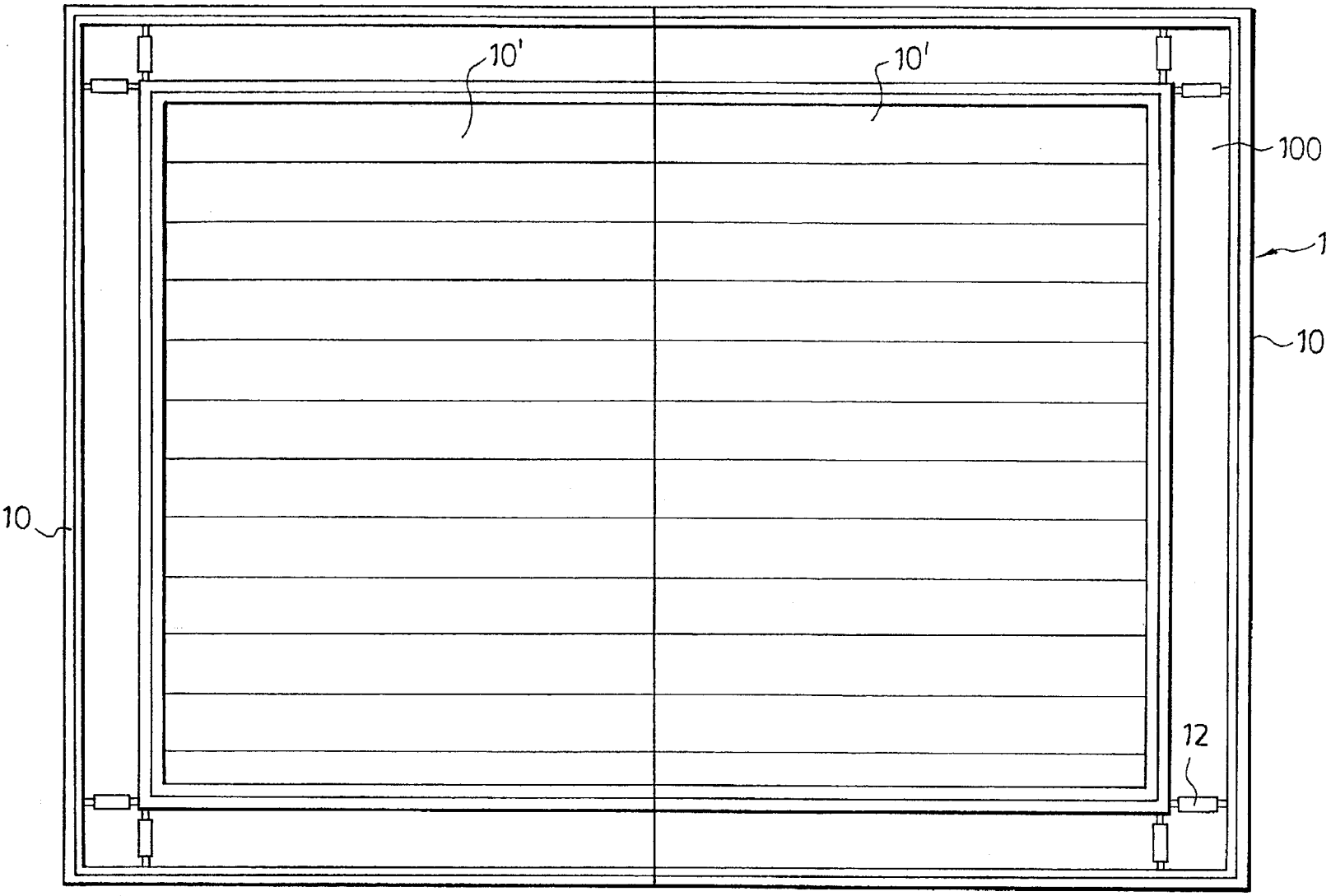
FIG. 2 illustrates interconnection between the floor halves of the floor unit of the modular house according to this invention.

Referring to FIG. 2, the floor assembly 1 includes two generally U-shaped unitary frames 10 defining a floor space therebetween and constituting an annular frame unit having a top surface formed with an annular groove 100, and a floor unit consisting of two rectangular floor halves 10' fitted within the floor space and abutting against each other side by side. The ground is dug in advance to form a rectangular cavity (not shown) so as to receive the floor assembly 1 fittingly, thereby positioning the floor assembly 1 in the cavity.

Figure 3:
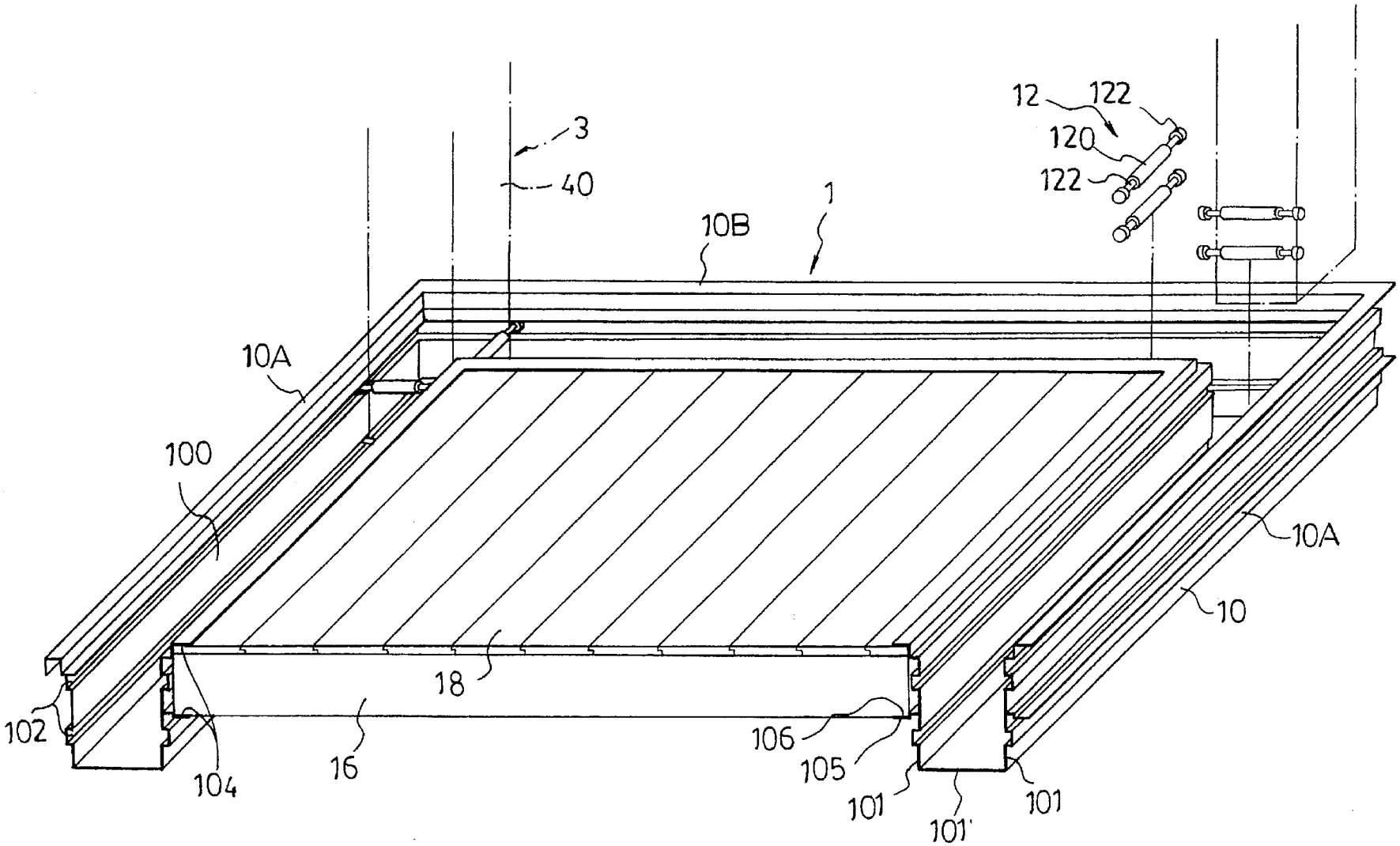
FIG. 3 is a partially exploded view illustrating interconnection between the frame unit and the floor unit and between the frame unit and the corner pillars of the modular house according to this invention.

Referring to FIG. 3, each of the frames 10 has two parallel and straight side bar portions 10A and a connecting bar portion 10B which have a generally U-shaped cross-section. Each of the bar portions 10A, 10B has two parallel vertical side walls 101 defining the annular groove of the annular frame unit therebetween, a horizontal bottom wall 101corner interconnecting the lower ends of the vertical side walls 101, and a floor supporting frame 105 (see FIG. 4) secured to the bar portion 10A, 10B and defining therein an open-ended horizontal floor slot 106 which is formed in one of the vertical side walls 101 along the total length of the bar portion 10A, 10B so that all of the floor slots 106 together constitute an annular floor slot unit in the inner peripheral surface of the annular frame unit. The outer peripheries of the floor halves 10' are respectively and slidably engaged within the floor slots 106 of the frames 10. Each of the floor halves 10' consists of a thick base plate 16, and a thin top plate 18 placed over the base plate 16. Each of the vertical walls 101 has two open-ended horizontal retainer slots 102 formed therein and in the annular groove 100.

Figure 5:
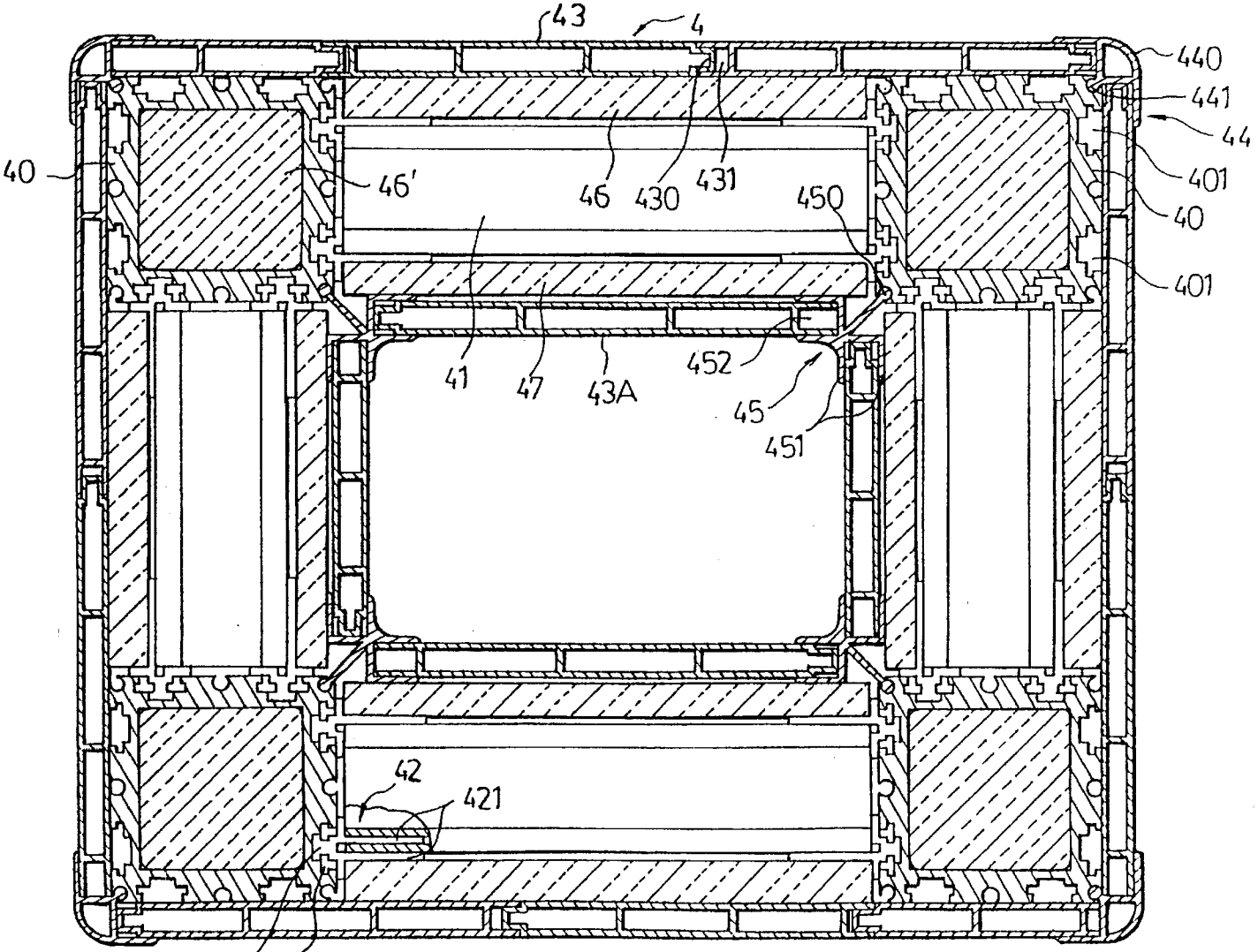
FIG. 5 is a sectional view showing the peripheral wall assembly of the modular house according to this invention.

Referring to FIGS. 5, the wall assembly 4 is disposed on the floor assembly 1 (see FIG. 1) and includes four rectangularly arranged corner pillars 40, four rail units 41, four rail retainer units 42, four spaced sets of removably interconnected outer wall sections 43, four outer corner posts 44, four inner wall sections 43A and four inner corner posts 45.

Figure 4:
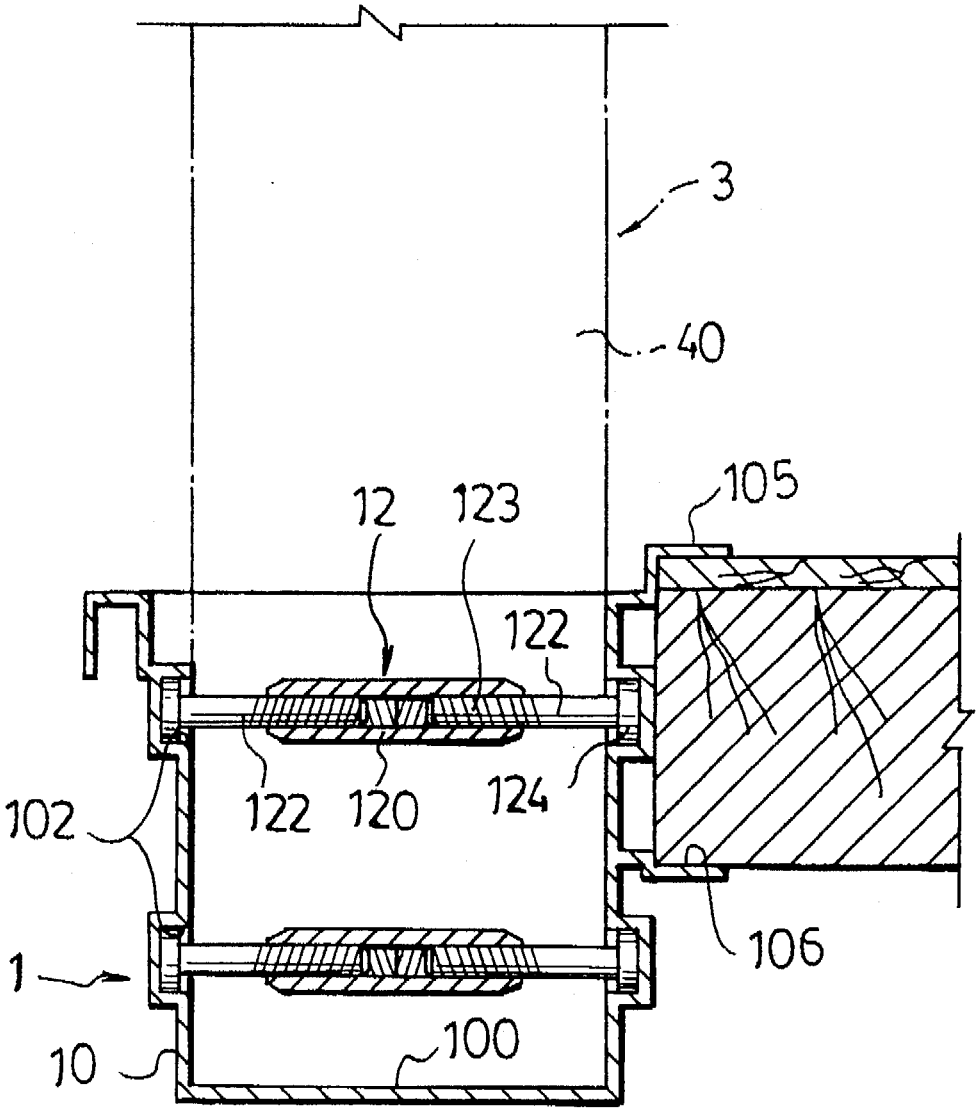
FIG. 4 illustrates interconnection between the frame unit and the pillar retainer members of the modular house according to this invention.

The corner pillars 40 define four wall spaces each of which is located between an adjacent pair of the corner pillars 40 and each of which receives one of the rail units 41 therein. Each of the corner pillars 40 has a lower end which is mounted securely in a corner of the annular groove 100 (see FIG. 3) of the annular frame unit of the floor assembly 1 (see FIG. 3) by a pillar retainer unit. As shown in FIG. 3 and 4, each of the pillar retainer units includes two pairs of pillar retainer members 12 each of which consists of an internally threaded sleeve 120 and two locking bars 122 each of that has an externally threaded inner end portion 123 engaged threadably with the sleeve 120, and an outer end 124 extending into the corresponding retainer slot 102 of the floor assembly and abutting against the corresponding vertical side wall 10A of the corresponding frame 10.

In each of the pillar retainer units, one adjacent pair of the pillar retainer members 12 are located at different level so as to press one of the corner pillars 40 against the corresponding side bar portions 10A of the corresponding frame 10, while the other pair of the pillar retainer members 12 are also located at different level so as to press the same corner pillar 40 against the corresponding connecting bar portion 10B of the corresponding frame 10.

Figure 6:
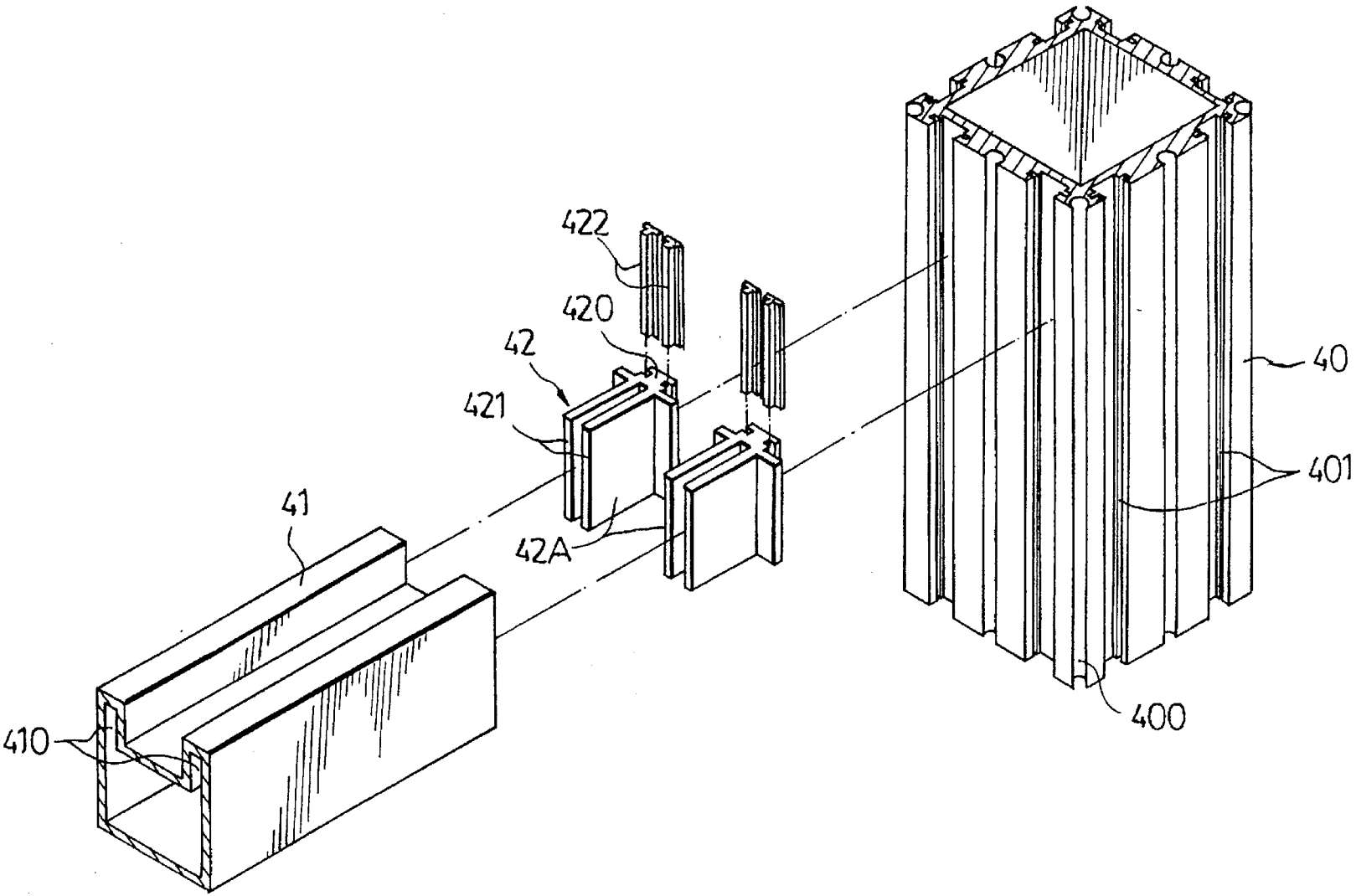
FIG. 6 illustrates how a rail is retained on a corner pillar by means of a rail retainer unit of the modular house in accordance with this invention.

As illustrated in FIG. 6, each of the corner pillars 40 has a generally rectangular tubular cross-section and includes four vertically extending corner slots 400 respectively formed in the corners thereof, and four side walls each of which is formed with two vertically extending positioning slots 401 of a generally cross-shaped cross-section. Each of the rail units 41 is tubular and has two inverted U-shaped portions 410 located at two sides thereof. Each of the rail retainer units 42 mounts removably one of the rail units 41 on the corresponding corner pillar 40 and includes two rail retainer members 42A each of which has a H-shaped-cross-sectioned portion 420 and two rail supporting portions 421, and two pairs of locking strips 422 of a T-shaped cross-section. Each of the H-shaped-cross-sectioned portions 420 of the rail retainer members 42A is engaged within the corresponding positioning slot 401 of the corner pillar 40. Each of the rail supporting portions 421 of the rail retainer members 42A is inserted into and supports the corresponding inverted U-shaped portion 410 of the corresponding rail unit 41 thereon. As illustrated, each adjacent pair of the locking strips 422 are located in the corresponding positioning slot 401 of the corresponding corner pillar 40 on two sides of the corresponding locking strips 422 and are respectively fitted within two spaces which are located between the corresponding rail retainer member 42A and the corresponding corner pillar 40., so as to mount the locking strips 422 securely on the corresponding corner pillar 40.

Again referring to FIG. 5, the outer corner posts 44 respectively have tongues 441 and are respectively and removably connected to the corner pillars 40 by engagement of the tongues 441 and the corner slots 400 (see FIG. 6), so that the outer wall sections 43 and the outer corner posts 44 together constitute an annular outer wall unit which surrounds the corner pillars 40 and the rail units 41. Similarly, the inner corner posts 45 respectively have tongues 450 and are respectively and removably connected to the corner pillars 40 by engagement of the tongues 450 and the corner slots 400 (see FIG. 6), so that the inner wall sections 43A and the inner corner posts 45 together constitute an annular inner wall unit, in such a manner that the corner pillars 40 and the rail units 41 are located between the inner and outer wall units. Each of the inner corner posts 45 further includes two connecting portions of a generally U-shaped cross-section each of which has two side walls 451 that together define an inner-wall positioning slot 452 therebetween. As illustrated, each of the outer and inner wall sections 43, 43A has a first end portion provided with a tongue 430, and a second end portion formed with a groove 431 within which the tongue 430 of another of the sections 43, 43A is engaged. To couple with the wall sections 43, 43A, each of the inner and outer corner posts 44, 45 has two connecting portions each of which is formed with a groove within which one of the wall sections 43, 43A is engaged. The outer wall unit has two opposite side walls each of which has a tapered top end portion 4A (see FIG. 1).

The wall assembly 4 further includes four outer rooms each of which is located in one of the wall spaces and between the outer wall unit and one of the rail units 41, and four vertical heat insulating plate units 46 which are disposed in the outer rooms respectively. In each of the corner pillars 40, a heat insulating post 46' corner is disposed for heat insulating purposes. Similarly, four sound absorbing plate unit 47 are respectively disposed within four inner rooms which are located in the wall spaces respectively between the inner wall unit and the rail units 41.

Figure 7:
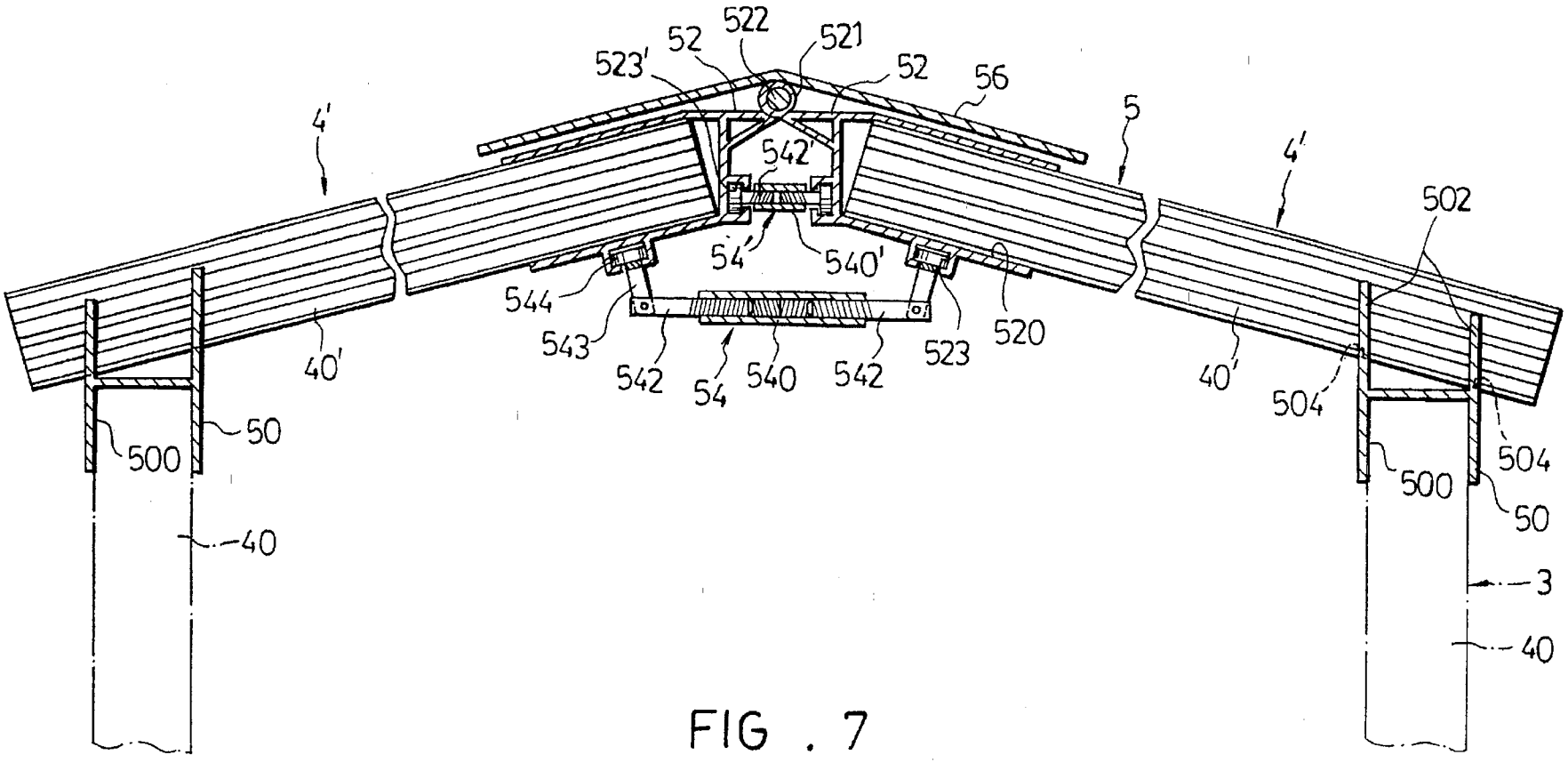
FIG. 7 is a sectional view showing the roof assembly of the modular house according to this invention.
Figure 8:
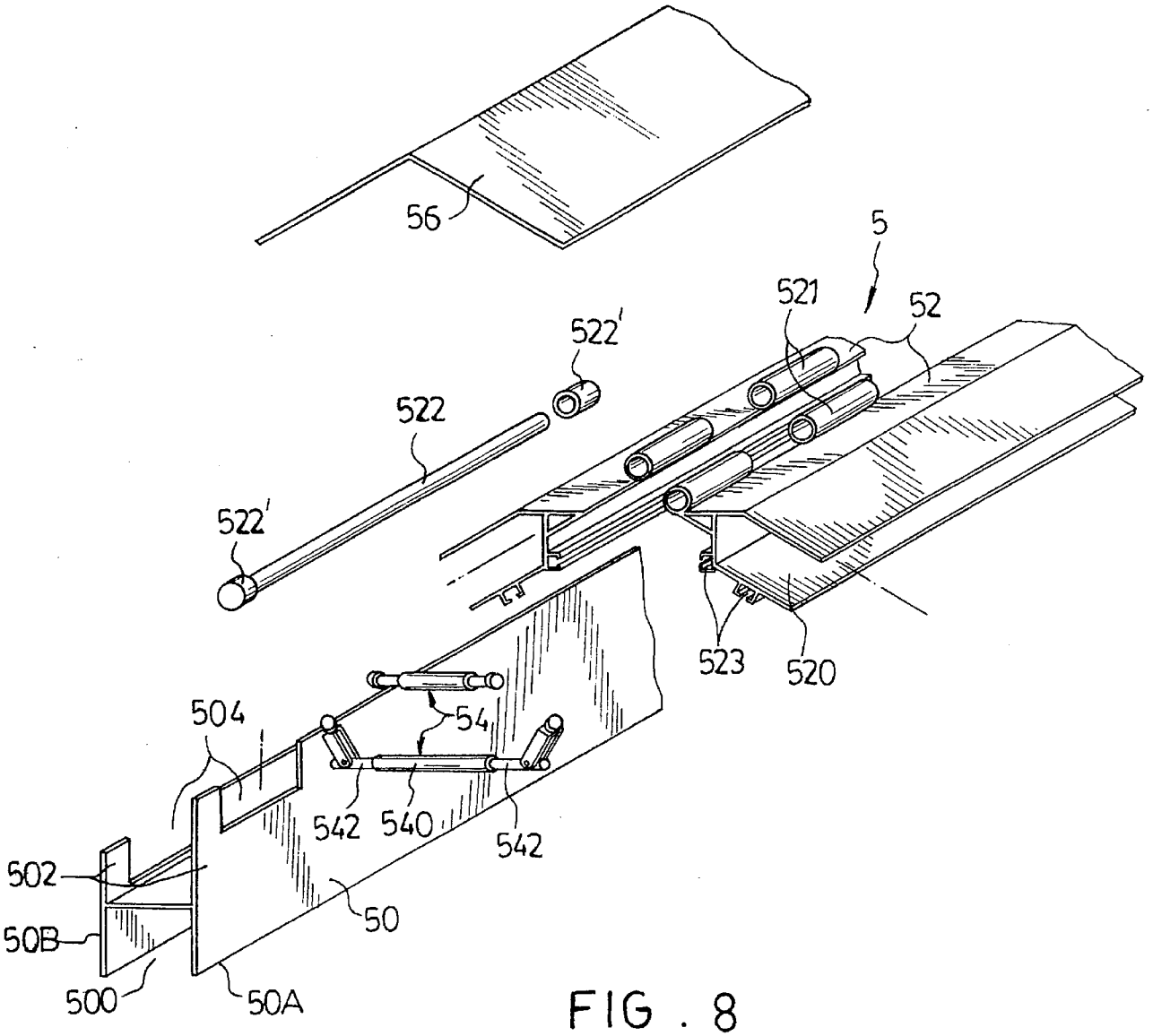
FIG. 8 is an exploded view showing a portion of the roof assembly of the modular house according to this invention.

Referring to FIGS. 7 and 8, the roof assembly 5 includes two support units 50 of a generally H-shaped cross-section with a higher vertical inner wall 50A and a lower vertical outer wall 50B, a pair of elongated horizontal beam units 52 interconnected detachably side by side, two inclined roof sheathing units 4' each of which has an upper end portion inserted into the groove 520 of the corresponding beam unit 52 and inclined downwardly and outwardly relative to the beam unit 52, and an inverted V-shaped cover plate 56 placed on the beam units 52 so as to cover the beam units 52 and the upper end portions of the sheathing units 4'. Each of the support units 50 has an insertion groove 500 which is defined between the higher vertical inner wall 50A and the lower vertical outer wall 50B so as to permit insertion of the top end portion of the corresponding corner pillar 40 therein. Each of the beam units 52 has a row of spaced sleeves 521 secured thereto. A coupler rod 522 is inserted through all of the sleeves 521 of the beam units 52. Two flexible retaining caps 522' are sleeved respectively and tightly on two ends of the coupler rod 522 and abut against the two outmost sleeves 521 respectively so as to connect rotatably the beam units 52 and so as to prevent relative movement of the beam units 52.

As best shown in FIG. 8, in each side portion of each of the support units 50, each of the inner and outer walls 50A, 50B has a rectangular notch 504.

Figure 9:
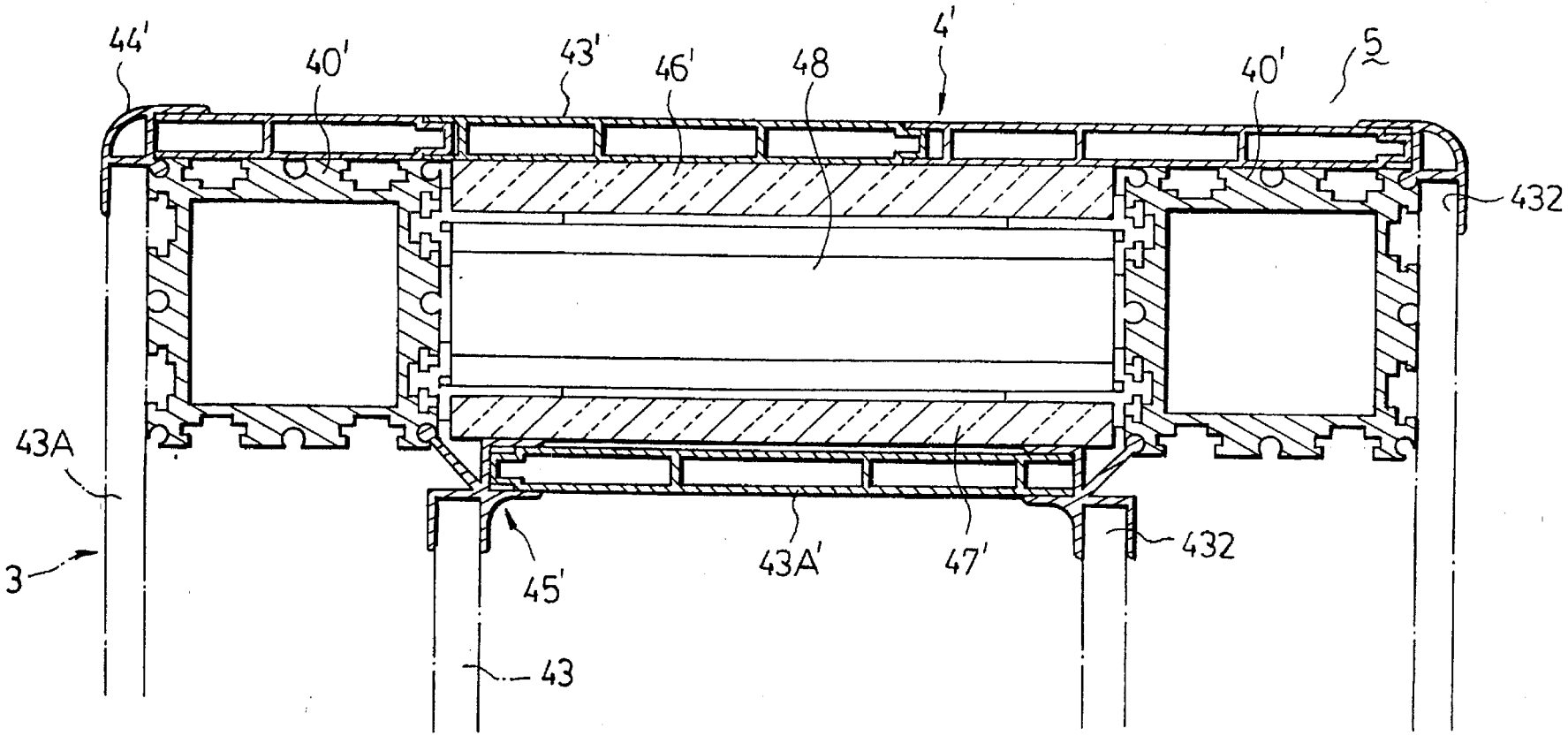
FIG. 9 illustrates interconnection between the wall assembly and the roof sheathing units of the modular house according to this invention.

Referring to FIGS. 5, 8 and 9, each of the roof sheathing units 4' includes two inclined sheathing rods 40' which are passed through the rectangular notches 504 of the inner and outer walls 50A, 50B and which are similar to the corner pillars 40 in construction, an inclined sheathing plate 48' coupled with the sheathing rods 40' in a manner in which the rail units 41 are connected to the corner pillars 40, two upper corner strips 44' similar to the outer corner posts 44 in construction and coupled with the upper portions of the sheathing rods 40' respectively in a manner in which the outer corner posts 44 are connected to the corner pillars 40, and several removably interconnected top plate sections 43A' similar to the outer wall sections 43 in construction and coupled with the outer corner posts 44 in a manner in which the outer wall sections 43 are connected to the outer corner posts 44. Two lower corner strips 45' are similar to the outer corner posts 44 in construction and are coupled with the lower portions of the sheathing rods 40' in a manner in which the outer corner posts 44 are connected to the corner pillars 40. A lower plate section 43' is similar to the inner wall sections 43A in construction and coupled with the outer corner posts 44 in a manner in which the inner wall sections 43A are connected to the outer corner posts 44. As illustrated, each of the upper and lower corner strips 44', 45' has a lower end surface formed with a slot 432 which is engaged with the top end portion of the corresponding wall section 43, 43A. A heat insulating plate unit 46' and a sound absorbing plate unit 47' are disposed between the sheathing rods 40' in a manner in which the heating plate unit 46 and the sound absorbing plate unit 47 are disposed between the corner pillars 40. Each pair of the sheathing rods 40' are interconnected by a rail 48 in a manner in which the corner pillars 40 are interconnected by the rail 41.

Again referring to FIG. 7, each of the beam units 52 has a bottom portion formed with an open-ended lower dovetail groove 523, and an inner portion formed with an open-ended upper dovetail groove 523'. A lower positioning device 54 includes an internally threaded sleeve 540, two horizontal links 542 each of which has an externally threaded inner end engaged threadably with the sleeve 540, and two inclined links 542 each of which has a lower end connected pivotally to the outer end of the corresponding horizontal link 542, and an enlarged end 544 which is engaged within the corresponding lower dovetail groove 523. An upper positioning device 54' includes an internally threaded sleeve 540', and two horizontal links 542 each of which has an externally threaded inner end engaged threadably with the sleeve 540, and an enlarged outer end which is engaged within the corresponding outer dovetail groove 523'. The lower and upper positioning devices 54, 54' cooperate with each other so as to prevent relative rotation of the sheathing units 4'.

Figure 10:
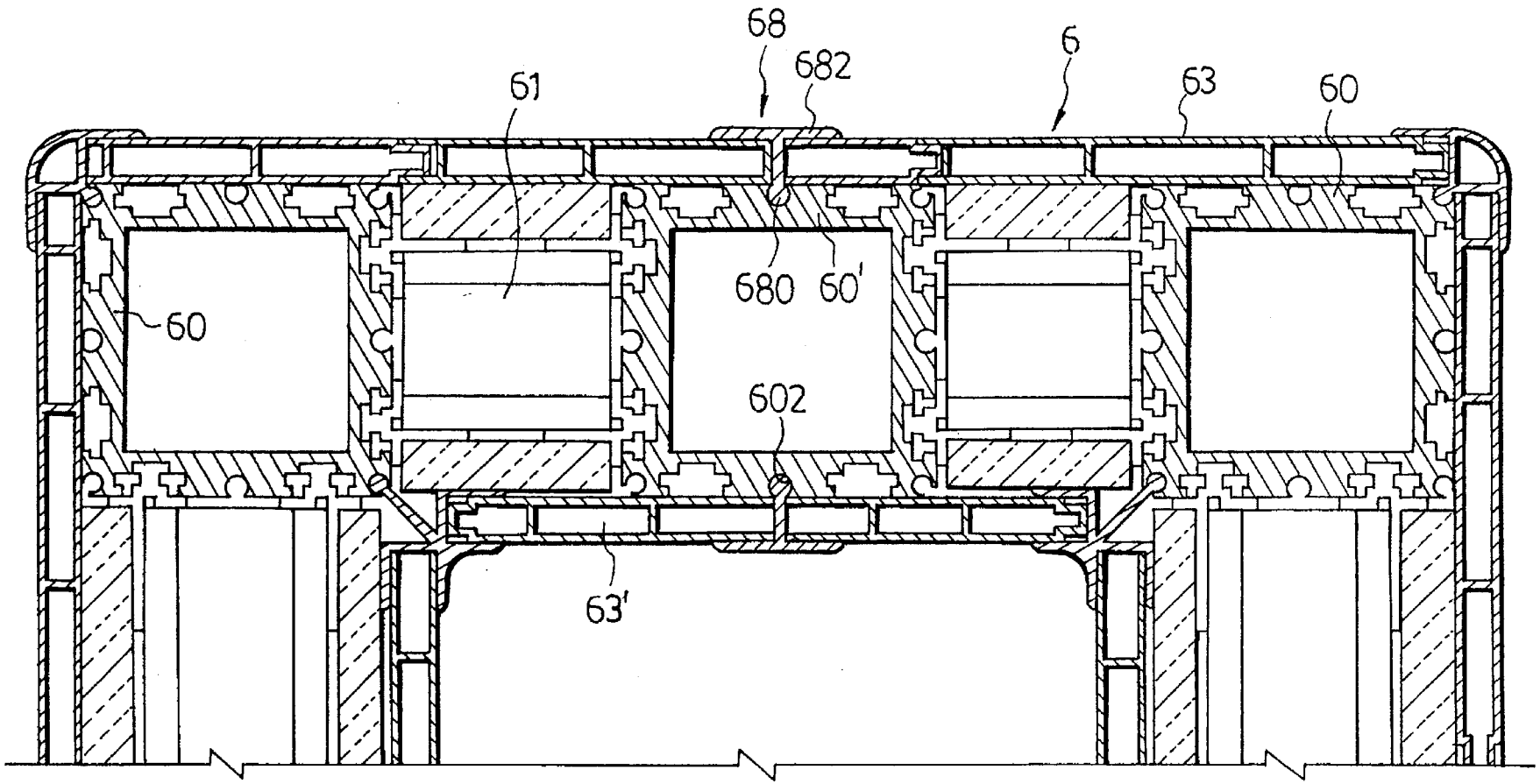
FIG. 10 illustrates an alternative wall assembly of the modular house according to this invention.

FIG. 10 shows a modified wall assembly 6 which includes four corner pillars 60 defining four wall spaces each of which is located between an adjacent pair of the corner pillars 60, and four rail units each of which is disposed in one of the wall spaces and each of which includes a vertical middle pillar 60' and two horizontal rails 61 each of that is coupled with one of the middle pillars 60' and one of the corner pillars 60 in a manner in which the rail units 41 (see FIG. 5) are connected to the corner pillars 40 (see FIG. 5). Each of the middle pillars 60' is connected to an adjacent one of the outer and inner wall units by a T-shaped retaining strip 68. Each of the retaining strips 68 has a tongue 680 engaged within the slot 602 of the corresponding middle pillar 60', so as to clamp two aligned outer or inner wall sections 63, 63' between the strip 68 and the middle pillar 60'.

Figure 11:
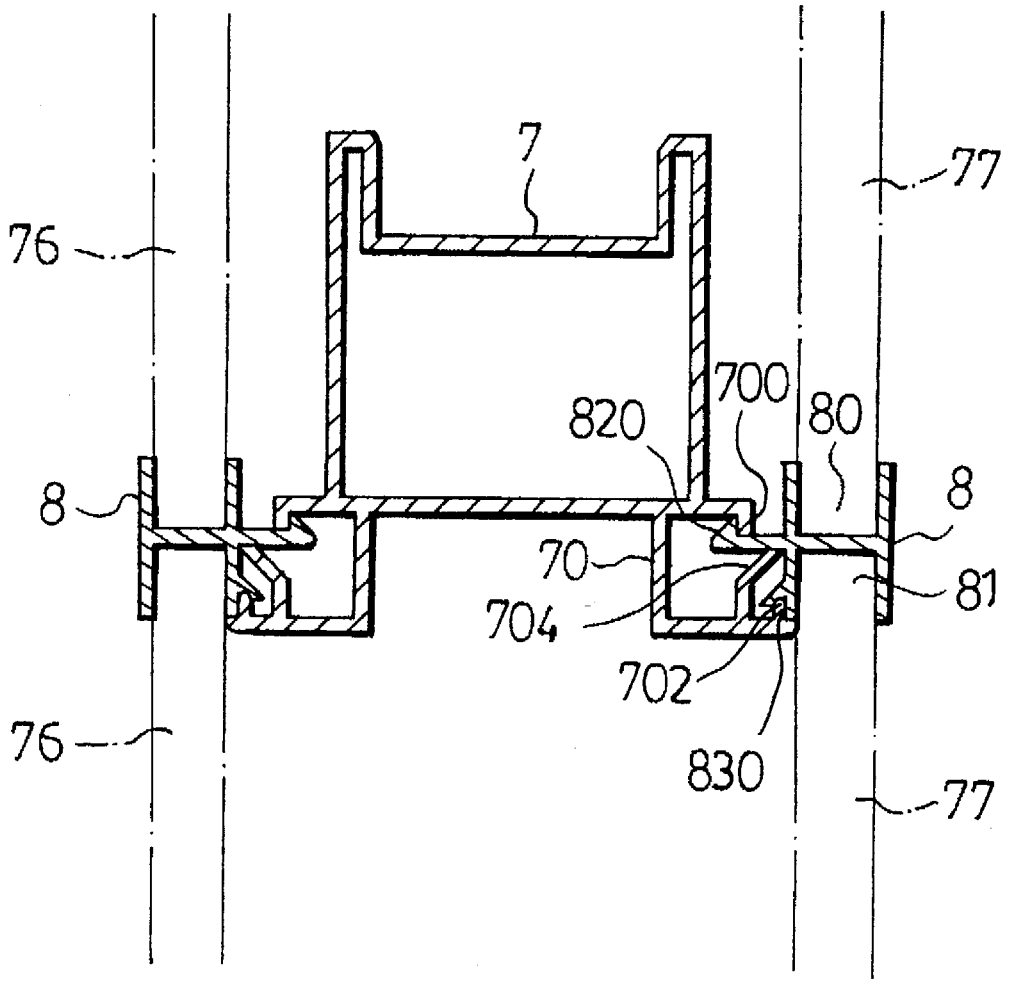
FIG. 11 illustrates how a vertical heat insulating plate unit and a vertical sound absorbing plate unit are coupled with a rail in accordance with this invention.

FIG. 11 shows an modified assembly including a heat insulating plate unit consisting two aligned heat insulating plates 76, a sound absorbing plate unit consisting of two sound absorbing plates 77, and a hollow rail 7. Each of the left and right side portions of the rail 7 has an integral retaining strip 700, an integral tongue strip 702 and a press strip 704. The rail 7 is coupled with each of the heat insulating plate unit and the sound absorbing plate unit by a connector 8, which includes a H-shaped outer section formed with two insertion grooves 80, 81 in which the plates 76, 77 are engaged, a barbed portion 820 engaging the corresponding retaining strip 700 of the rail 7, and a retaining slot 830 engaging the corresponding tongue strip 702 of the rail 7, so as to retain the connectors 8 on the rail 7, thereby positioning the heat insulating plates 76 and the sound absorbing plates 77 relative to the rail 7.

With this invention thus explained, it is apparent that numerous modifications and variations can be made without departing from the scope and spirit of this invention. It is therefore intended that this invention be limited only as indicated in the appended claims.

I claim:

1. A modular house comprising:

a floor assembly including an annular frame unit adapted to be received fittingly within a rectangular cavity in ground, and a floor unit fitted within said annular frame unit, said annular frame unit including two generally U-shaped frames which abut against each other and define a floor space therebetween, a top surface formed with an annular groove, and an inner peripheral surface formed with an annular floor slot unit, each of said U-shaped frames having two parallel and straight side bar portions and a connecting bar portion interconnecting said side bar portions at one end thereof to form said U-shaped frame, each of said side bar portions and said connecting bar portions of said frames having a generally U-shaped cross-section and having two parallel vertical side walls defining said annular groove therebetween, a horizontal bottom wall interconnecting lower ends of said side walls, and an open-ended horizontal floor slot formed in one of said vertical side walls along total length of said two side bar portions and said connecting bar portion of each U-shaped frame so that said floor slots together constitute said floor slot unit, said floor unit including two floor halves which have outer peripheries respectively and slidably engaged within said floor slots of said frames and which abut against each other side by side;

a peripheral wall assembly including four rectangularly arranged vertical corner pillars defining four wall spaces each of which is located between an adjacent pair of said corner pillars, four pillar retainer units respectively and removably mounting lower end portions of said corner pillars in said annular groove of said annular frame unit, four horizontal rail units disposed in said wall spaces respectively, four rail retainer units respectively and removably mounting said rail units on said corner pillars, four spaced sets of removably interconnected outer wall sections, four outer corner posts respectively and removably connected to said corner pillars so that said outer wall sections and said outer corner posts together constitute an annular outer wall unit which surrounds said corner pillars and said rail units, four spaced sets of removably interconnected inner wall sections, and four inner corner posts respectively and removably connected to said corner pillars so that said inner wall sections and said inner corner posts together constitute an annular inner wall unit, in such a manner that said corner pillars and said rail units are located between said inner and outer wall units, said outer wall unit having two opposite side walls each of which has a tapered top end portion; and an inverted V-shaped roof assembly mounted removably on said wall assembly.

2. A modular house as claimed in claim 1, wherein said roof assembly includes two elongated horizontal beam units interconnected detachably side by side, two inclined roof sheathing units each of which has an upper end portion connected detachably to said beam units and inclined downwardly and outwardly relative to said beam units, and an inverted V-shaped cover plate placed on said beam units so as to cover said beam units and said upper end portions of said sheathing units.

3. A modular house as claimed in claim 1, wherein each of said vertical side walls of said frames has two horizontal retainer slots which are formed therein and in said annular groove along total length of said vertical side wall and which are located at different levels, each of said pillar retainer units including two pairs of pillar retainer members each of which has a sleeve with to internally threaded end portions, and two locking bars each of which has an externally threaded inner end portion engaged threadably with one of said internally threaded end portions of said sleeve, and an outer end extending into one of said retainer slots of said frames and abutting against a corresponding one of said side walls of said frames, one adjacent pair of said pillar retainer members of each of said pillar retainer units being located at different levels so as to press one of said corner pillars against a corresponding one of said side bar portions of said frames, while said other pair of said pillar retainer members of each of said pillar retainer units are located at different levels so as to press said one of said corner pillars against a corresponding one of said connecting bar portions of said frames.

4. A modular house as claimed in claim 1, wherein said wall assembly further includes four outer rooms located in said wall spaces respectively, and four vertical heat insulating plate units which are disposed in said outer rooms respectively, each of said outer rooms being positioned between said outer wall unit and one of said rail units.

5. A modular house as claimed in claim 1, wherein said wall assembly further includes four inner rooms located in said wall spaces respectively, and four vertical sound absorbing plate units which are disposed in said inner rooms respectively, each of said inner rooms being positioned between said inner wall unit and one of said rail units.

6. A modular house as claimed in claim 1, wherein each of said corner pillars has a generally rectangular tubular cross-section provided with four side walls each of which has two vertically extending positioning slots of a generally cross-shaped cross-section, each of said rail retainer units including two rail retainer members and two pairs of locking strips of a T-shaped cross-section, each of said rail retainer members having a H-shaped-cross-sectioned portion engaged within one of said positioning slots, and a rail supporting portion on which one of said rail units is positioned, each adjacent pair of said locking strips being located in one of said positioning slots of said corner pillars on two sides of said corresponding one of said locking strips, and being respectively fitted within two spaces which are located between a corresponding one of said rail retainer members and a corresponding one of said corner pillars, so as to mount said locking strips securely on said corresponding one of said corner pillars.

7. A modular house as claimed in claim 1, wherein each of said beam units includes a row of spaced sleeves secured thereto, said roof assembly further including a coupler rod extending through said sleeves of said beam units, and two flexible retaining caps respectively and tightly sleeved on two ends of said coupler rod so as to prevent removal of said coupler rod from said sleeves.

8. A modular house as claimed in claim 1, wherein each of said rail units includes a horizontal rail interconnecting an adjacent pair of said corner pillars.

9. A modular house as claimed in claim 1, wherein each of said rail units includes a vertical middle pillar, and two horizontal rails each of which is coupled with one of said middle pillars and one of said corner pillars, said wall assembly including four T-shaped retaining strips, each of said middle pillars being connected to an adjacent one of said outer and inner wall units by one of said T-shaped retaining strips, each of said retaining strips being connected detachably to a corresponding one of said middle pillars, so as to clamp one of said inner and outer wall units between said retaining strip and the corresponding one of said middle pillars.

* * * * *

UNITED STATES PATENT AND TRADEMARK OFFICE

CERTIFICATE OF CORRECTION

PATENT NO. : 5,647,177
DATED : July 15, 1997
INVENTOR(S) : Jong-Liang Hwang

It is certified that error appears in the above-indentified patent and that said Letters Patent is hereby corrected as shown below:

Claim 1, column 6, line 24, insert --a-- after "along".

Claim 3, column 7, line 2, insert --a-- after "along";

line 11, "one adjacent pair" should read --the pillar retaining members of one pair--; and line 15, before "said" (first occurrence) insert --the pillar retaining members of--.

Signed and Sealed this

Thirteenth Day of January, 1998

Bruce Lehman

*Attest:*

BRUCE LEHMAN

*Attesting Officer*

*Commissioner of Patents and Trademarks*